US010328555B2

(12) United States Patent
Franz et al.

(10) Patent No.: US 10,328,555 B2
(45) Date of Patent: Jun. 25, 2019

(54) DRIVING-IN DEVICE

(71) Applicant: Hilti Aktiengesellschaft, Schaan (LI)

(72) Inventors: Karl Franz, Feldkirch (AT); Mario Grazioli, Chur (CH); Iwan Wolf, Untervaz (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 376 days.

(21) Appl. No.: 15/038,092

(22) PCT Filed: Nov. 26, 2014

(86) PCT No.: PCT/EP2014/075604
§ 371 (c)(1),
(2) Date: May 20, 2016

(87) PCT Pub. No.: WO2015/082262
PCT Pub. Date: Jun. 11, 2015

(65) Prior Publication Data

US 2016/0303723 A1 Oct. 20, 2016

(30) Foreign Application Priority Data

Dec. 4, 2013 (EP) ..... 13195724

(51) Int. Cl.
*B25C 1/06* (2006.01)
*B25F 5/02* (2006.01)

(52) U.S. Cl.
CPC ..... *B25C 1/06* (2013.01); *B25F 5/021* (2013.01)

(58) Field of Classification Search
CPC ..... B25C 1/06; B25F 5/02
(Continued)

(56) References Cited

U.S. PATENT DOCUMENTS 4,700,876 A * 10/1987 Wingert ..... B25F 5/02 227/131
6,840,289 B2 1/2005 Hillegonds
(Continued)

FOREIGN PATENT DOCUMENTS

CN 102039583 A 5/2011
CN 102284928 B 5/2016
(Continued)

OTHER PUBLICATIONS

Chinese Patent Office, Office Action in Chinese Patent Application No. 201480066604.4 dated Sep. 28, 2017.
(Continued)

*Primary Examiner* — Andrew M Tecco
*Assistant Examiner* — Praachi M Pathak
(74) *Attorney, Agent, or Firm* — Leydig Voit & Mayer

(57) ABSTRACT

The invention relates to a device for driving a securing element into a substrate, having a mechanical energy store for storing mechanical energy; an energy transmitting element for transmitting energy from the mechanical energy store to the securing element; an energy transmitting device for transmitting energy from an energy source to the mechanical energy store; a housing with a first and a second housing part, said first housing part being connected to the second housing part in order to form an interior between the first and second housing part, the mechanical energy store being arranged in said interior; and an intermediate element, by means of which the mechanical energy store can be secured to the first housing part at least temporarily while energy is stored in the mechanical energy store.

18 Claims, 13 Drawing Sheets

(58) Field of Classification Search
USPC ..... 227/146
See application file for complete search history.

(56) References Cited

U.S. PATENT DOCUMENTS

| | | | | |
|---|---|---|---|---|
| 7,815,088 | B2 * | 10/2010 | Fielitz | B25C 5/15 227/129 |
| 8,011,441 | B2 * | 9/2011 | Leimbach | B25C 1/047 173/1 |
| 2002/0096343 | A1 | 7/2002 | Potter et al. | |
| 2007/0102471 | A1 | 5/2007 | Gross et al. | |
| 2011/0203824 | A1 | 8/2011 | Elger et al. | |
| 2011/0303726 | A1 | 12/2011 | Blessing et al. | |
| 2011/0303728 | A1 | 12/2011 | Franz et al. | |

FOREIGN PATENT DOCUMENTS

| | | | |
|---|---|---|---|
| DE | 102009045603 | A1 | 4/2011 |
| EP | 1 415 916 | A1 | 5/2004 |
| JP | 2012-000764 | A | 1/2012 |

OTHER PUBLICATIONS

European Patent Office, European Search Report in European Patent Application No. 13195724.3, dated Jun. 16, 2014.
International Bureau, International Search Report in International Patent Application No. PCT/EP2014/075604, dated Jan. 27, 2015.

* cited by examiner

DRIVING-IN DEVICE

CROSS-REFERENCE TO RELATED APPLICATIONS

This patent application is the U.S. National Stage of International Patent Application No. PCT/EP2014/075604, filed Nov. 26, 2014, which claims the benefit of European Patent Application No. 13195724.3, filed Dec. 4, 2013, which are each incorporated by reference.

TECHNICAL FIELD

The application relates to a device for driving a fastening element into an underlying surface.

BACKGROUND OF THE INVENTION

Such devices typically comprise a piston for transmitting energy to the fastening element. The required energy must be provided in a very short time, which is why in so-called spring nailers, for example, a spring is first tensioned that abruptly transmits the tensioning energy during the driving process to the piston and accelerates the latter toward the fastening element.

The energy with which the fastening element is driven into the underlying surface has an upward bound for such devices, so that the devices cannot be arbitrarily used for all fastening elements and every underlying surface. It is therefore desirable to make driving devices available that can transmit sufficient energy to a fastening element.

BRIEF SUMMARY OF THE INVENTION

According to one aspect of the invention, a device for driving a fastening element into an underlying surface comprises a mechanical energy accumulator for storing mechanical energy; an energy transmitting element for transmitting energy from the mechanical energy accumulator to the fastening element; an energy transmitting device for transmitting energy from an energy source to the mechanical energy accumulator; a housing with a first and a second housing part, the first housing part being connected to the second housing part in order to form an interior, in which the mechanical energy accumulator is arranged, between the first and second housing part; and an intermediate element, by means of which the mechanical energy accumulator can be secured to the first housing part at least temporarily while energy is being stored in the mechanical energy accumulator. This simplifies the installation and/or removal of an already pretensioned mechanical energy accumulator.

According to an advantageous embodiment, the mechanical energy accumulator is supported firstly on the first housing part and secondly on the intermediate element against release of the energy stored in the mechanical energy accumulator. According to an alternative embodiment, the mechanical energy accumulator is supported only on the first housing part against release of the energy stored in the mechanical energy accumulator. According to an alternative embodiment, the mechanical energy accumulator is supported only on the intermediate element against release of the energy stored in the mechanical energy accumulator.

According to an advantageous embodiment, the intermediate element divides the interior into a first partial chamber and a second partial chamber. In that way, a preferably dust-tight and particularly preferably an air-tight separation of the first and the second partial chambers is implemented. For this purpose, the intermediate element preferably has a sealing element which particularly preferably closes off the intermediate element circumferentially. The first partial chamber is preferably closed dust-tightly relative to the surroundings and particularly preferably air-tightly, and the second partial chamber can be ventilated with ambient air. Thereby it is possible to ventilate a heat-producing device such as an electric motor without contaminating a dust-sensitive device such as a mechanical energy accumulator. The mechanical energy accumulator is therefore preferably arranged in the first partial chamber. The energy transmission device also preferably comprises a motor that is arranged in the second partial chamber. The energy transmission device also preferably comprises a transmission that is arranged in the first partial chamber.

The motor, the transmission if present, a sensor and/or an electrical line are preferably mounted on the intermediate element.

According to an advantageous embodiment, the mechanical energy accumulator comprises a helical spring. According to another advantageous embodiment, the mechanical energy accumulator comprises a gas spring.

According to an advantageous embodiment, the energy transmission device comprises a motion converter having a rotary drive and a linear output for converting a rotational movement into a linear movement. Thus a rotation of a motor, for example, produces a linear tensioning motion of the mechanical energy accumulator. The motion converter is preferably arranged in the first partial chamber. The motion converter also comprises a spindle drive comprising a spindle and a spindle nut arranged on the spindle.

BRIEF DESCRIPTION OF THE SEVERAL VIEWS OF THE DRAWING(S)

Embodiments of a device for driving a fastener element into an underlying surface will be described in detail below using examples, with reference to the drawings. Therein:

DETAILED DESCRIPTION OF THE INVENTION

Figure 1:
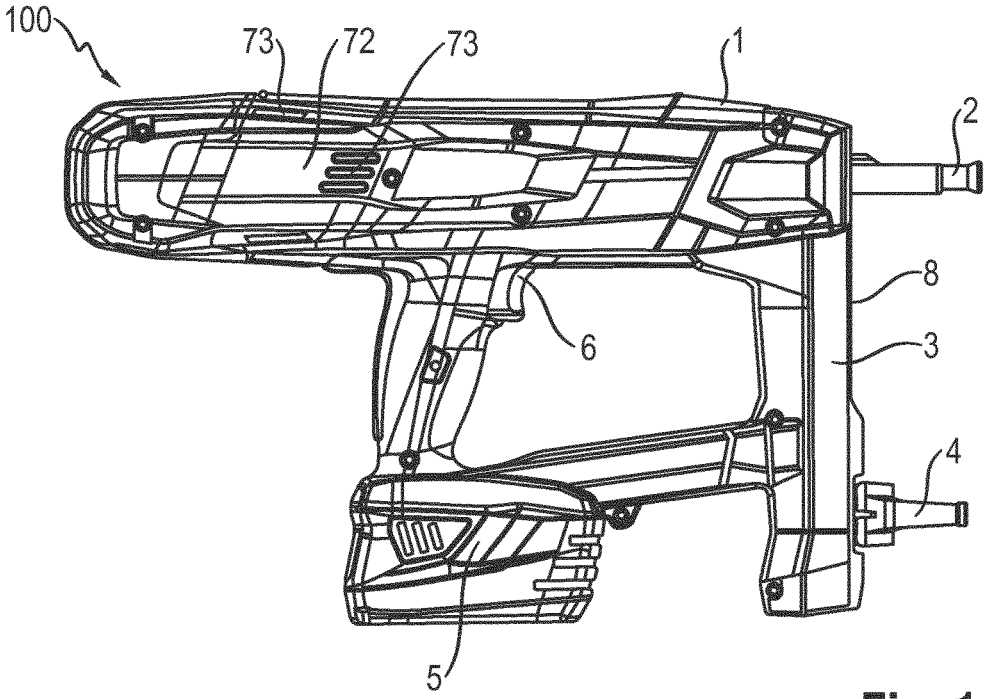
FIG. 1 shows a side view of a driving device.
Figure 2:
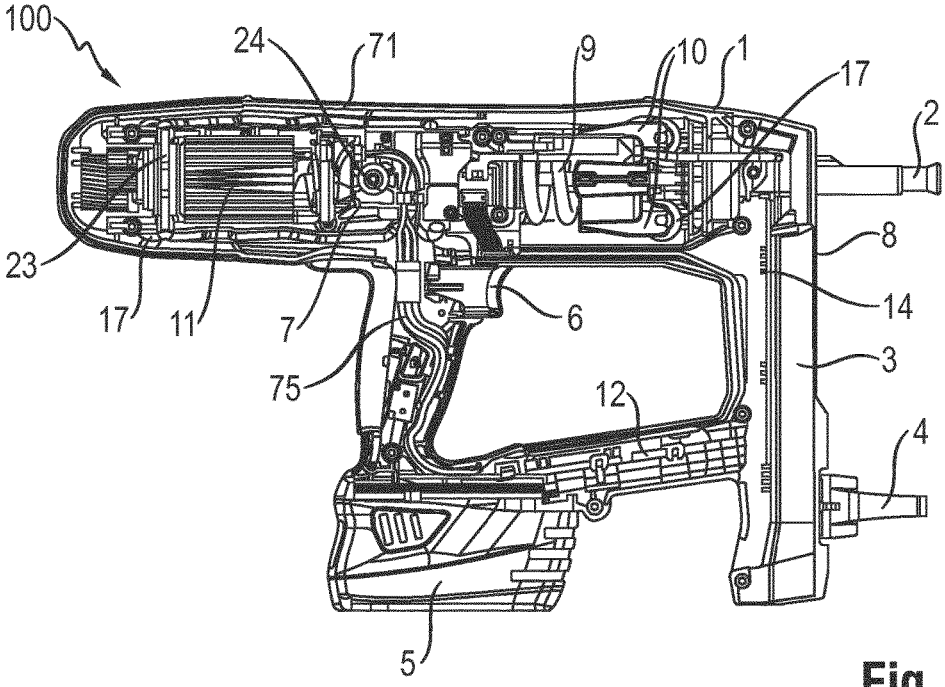
FIG. 2 shows a side view of a driving device with an opened housing.
Figure 3:
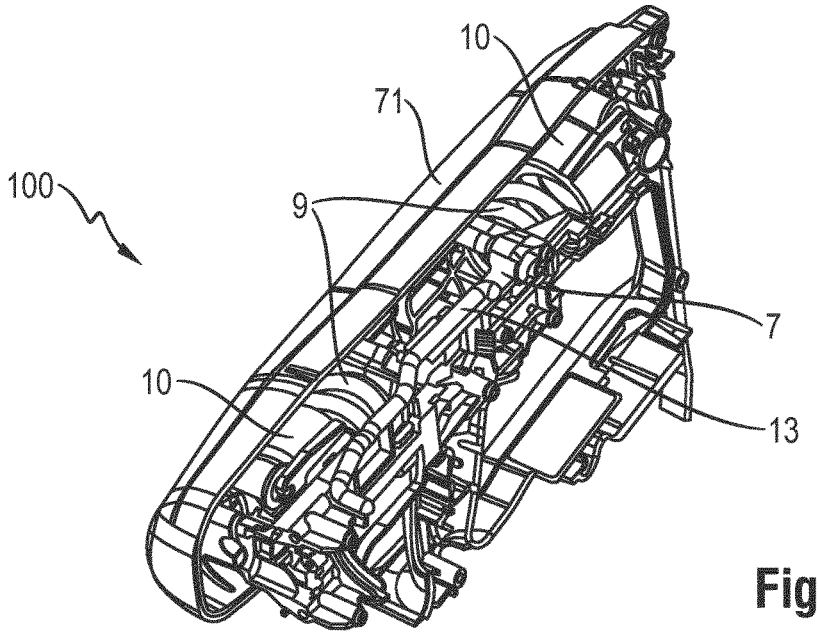
FIG. 3 shows a partial view of a driving device.
Figure 4:
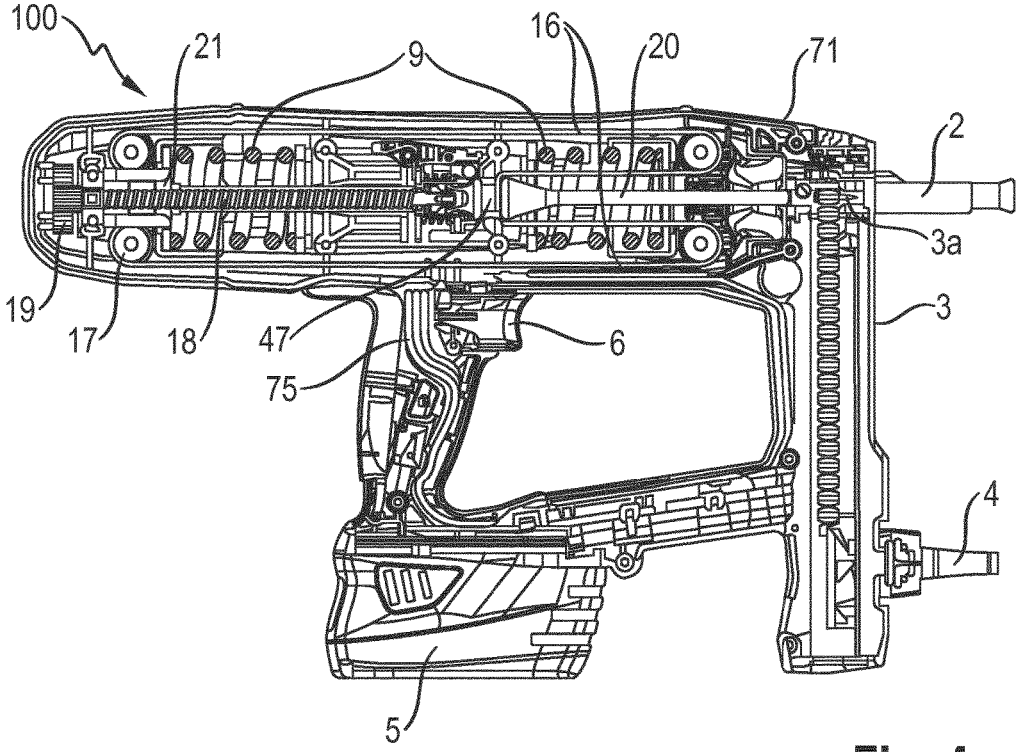
FIG. 4 shows a side view of a driving device with an opened housing.

FIGS. 1-4 show a battery-operated fastener-setting tool 100 as a device for driving a fastening element into an underlying surface. The fastener-setting tool 100 comprises a housing 1 that contains a brushless DC motor 11, a mechanical energy accumulator designed as two helical springs 9 and a nail driving device. The housing also contains a control electronics unit 12 for controlling the operation and a sensor system for determining tool states. The energy for loading the helical springs 9 is provided by a rechargeable battery 5 which is detachable from the tool and thus serves as an energy source. The tool has a fastener guide 2 as a pressing probe, which is pressed against an underlying surface during use of the fastener-setting tool 100. Thereby the fastener-setting tool 100 is put into triggering standby and the user can pull a trigger 6. A magazine 3 bears a plurality of fastening means designed as nails 3*a*, which are supplied to the fastener-setting tool 100. The magazine 3 has a support base 4, which helps the user press the fastener-setting tool 100 at a right angle onto the underlying surface.

The housing 1 comprises a first housing part 71 and a second housing part 72, which are connected to one another in such a manner that an interior, in which the helical springs 9 are arranged, is formed between them. An intermediate element is designed as an intermediate plate 7 having a sealing element 13 and arranged between the first housing part 71 and a second housing part 72 in such a manner that the intermediate plate 7 separates two partial chambers from one another. A first partial chamber is formed between the intermediate plate 7 and the first housing part 71, and a second partial chamber is formed between the intermediate plate 7 and the second housing part 72. The housing 1 further comprises a cover hood 8 in an anterior region of the fastener-setting tool 100.

The intermediate plate 7, together with the first housing part 71, forms the support for the upright ends of the two helical springs 9. The other end of the springs is supported on two roller brackets 10, which are mounted axially movably in the housing 1. Thereby four different spaces are formed inside the housing 1, namely the first partial chamber, closed off dust-tightly from the surroundings and in which the helical springs 9 are arranged; the second partial chamber, which can be vented via venting slots 73 in the second housing part 72 and in which the motor 11 is arranged; a handle region 74 through which electrical lines 75 are routed between the motor 11 and the control electronics unit 12; and a magazine region in which the nails 3*a* are transported. Since many mechanical parts are mounted directly in the plastic housing, stability and impact resistance of the housing 1 are important. Therefore it is proposed that the housing 1 and/or other supporting parts such as the intermediate plate 7 be produced from fiber-reinforced plastic, in particular PA12. In embodiments that are not shown, PA6 is used alternatively or additionally.

The cover hood 8, together with the first housing part 71 and the second housing part 72, forms the magazine 3, in which the nails 3*a* are stored and transported before each setting, in front of an energy transmission element designed as a piston 20. The cover hood 8 is connected at least partly by catch hooks 14 to the first housing part 71 and the second housing part 72.

The motor 11 is subject to high acceleration forces occur during setting in the fastener-setting tool. To protect the motor 11 from such forces, it is mounted in a damped manner relative to the intermediate plate 7 and the housing 1 by means of a motor damper 23. For example, the motor damper 23 can be directly injection-molded or vulcanized onto the motor assembly. This leads to a cost-effective design. To obtain good damping values that are, in particular, independent of the ambient temperature, the damper is preferably produced from polyurethane. In order to limit the exclusion of the damped motor, the motor is stopped after a defined excursion by a damped stop 24. The damped stop 24 is attached to the intermediate plate 7 in the embodiment shown. In the other movement direction, the motor 11 likewise has an end stop, not shown here, in the housing 1. It is designed as a fixed or damped stop.

Figure 5:
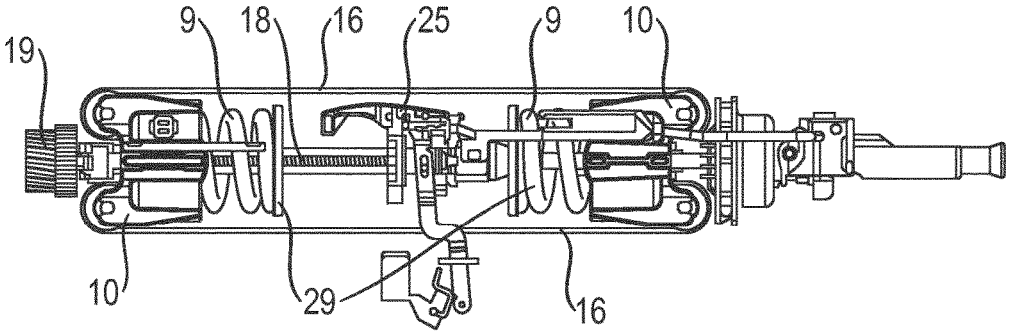
FIG. 5 shows an energy transmission device of a driving device.

FIG. 5 shows essential parts of the energy transmission device. A ball screw 18, which is driven by the motor 11 via a transmission 19, is mounted in the rear part of the fastener-setting tool 100. The rotational motion of the ball screw 18 is converted into a linear motion of a spindle nut 21. A tensioning belt 16 foxed to the spindle nut 21 transmits the linear movement to the rollers 17 and therefore to the roller brackets 10 that tension the helical springs 9. The tensioning belt 16 running through an opening in the piston 20 then transmits the tensioning force of the helical springs 9 to the piston and can accelerate the piston in the direction of the front aperture of the tool as soon as it is released by a clutch 25 mounted in the fastener-setting tool 100. The tensioning belt 16 guided through the opening of the piston 20 transmits power to the piston. In the area of the opening, the tensioning belt 16 is preferably made with a softer weave in comparison to the remainder of the belt 16 in order to prevent the belt from being damaged by the strong deflection under a high load.

The transmission 19 consists of at least one stage and can be designed as a gear transmission or a belt transmission. The gear wheels or belt wheels are preferably made from a plastic material. Metal spring supports 29 are used to mount the helical springs 9 between the first housing part 71 and the intermediate plate 7 in order to protect the plastic parts from wear.

The position of the roller bracket 10 can be determined by means of a magnet 46 attached to the roller bracket 10 and a sensor system described below. The roller bracket stands here as an example for various parts in the tool, the positions of which are of interest for controlling the fastener-setting tool 100. In particular, these parts are monitored with a sensor system; in the described embodiment it uses magnets and Hall sensors. The magnet 46 is ideally snapped into plastic parts.

Figure 6:
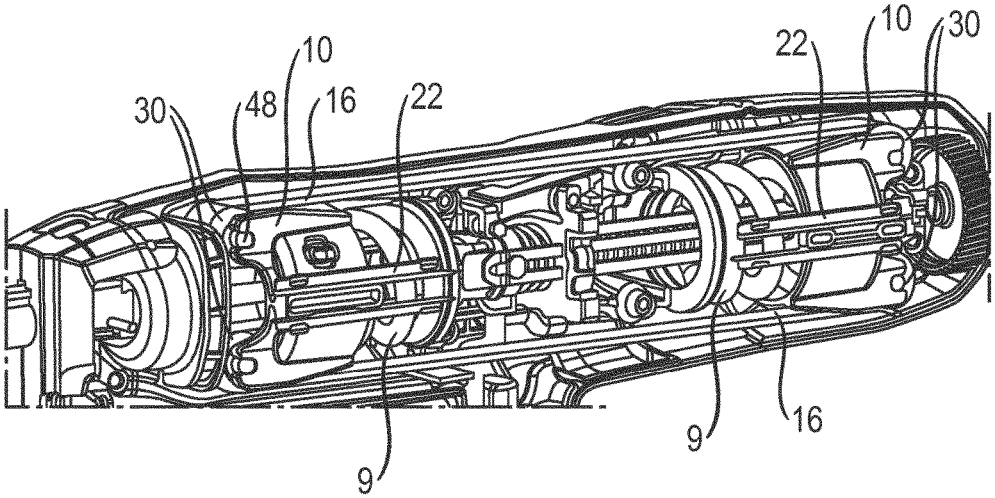
FIG. 6 shows a partial view of a driving device.

FIG. 6 shows that a force is transmitted to the roller bracket 10 by the tensioning belt 16 in order to tension the helical springs. Guide plates 22, which offer stable guidance with low wear for the roller brackets 10, are snapped into place in the housing 1 and in the intermediate plate 7 in order to support the roller brackets 10. The guides have different widths on each side of the roller bracket 10 in the housing 1, whereby incorrect installation is avoided. Two deflection rollers 30 that deflect the tensioning belt 16 by 180° are mounted on the roller brackets 10. Since the tensioning belt 16 is loaded by high forces, the deflection rollers 30 are preferably coated in order to reduce friction due to slippage between the tensioning belt 16 and the defection roller 30 during acceleration. This reduces the wear on the tensioning belt 16. For simplified installation, the deflection rollers 30 are mounted on cylindrical axles 48 that are snapped into the roller brackets.

Figure 7:
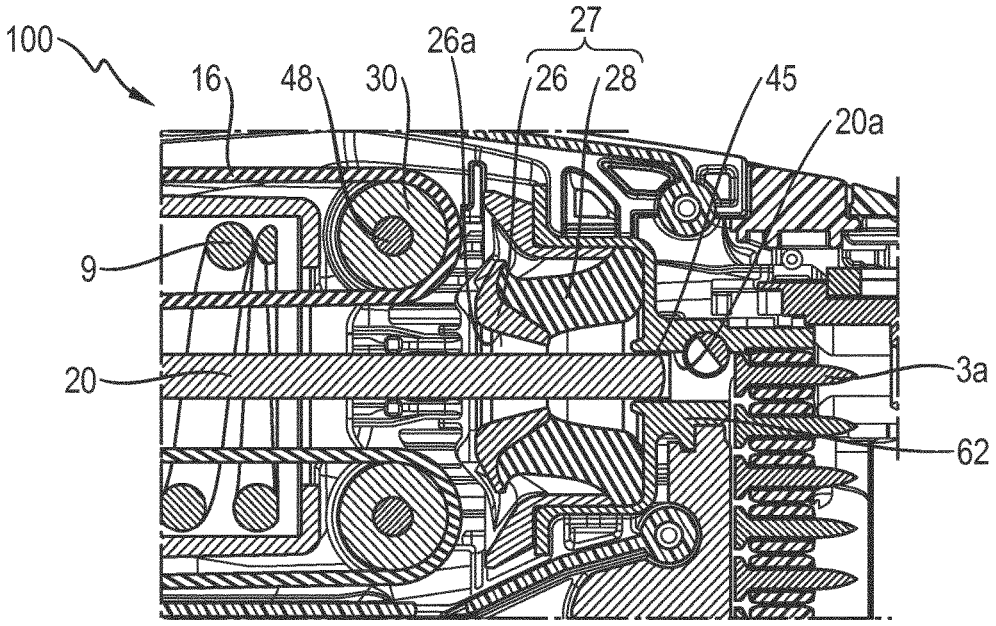
FIG. 7 shows a partial sectional view of a driving device.

FIG. 7 shows a section through the front part of the drive mechanism. A piston brake 27 mounted in this front part can catch the piston 20 in the event that not all the energy from the piston is transmitted to the fastening element during driving. In the embodiment shown, the piston brake 27 consists of a metallic cone ring 26 having a conical contact surface 26*a* for the piston 20 and also having an adjoining damping element 28. The damping element 28 can be made of polyurethane, for example, and injection molded directly onto the cone ring 26. The cone ring 26 can additionally have a coating that reduces the friction between the piston 20 and the cone ring 26. This can prevent jamming of the piston 20 in the cone ring 26.

Also visible in FIG. 7 is a piston seal ring 45, which seals the piston along 20 with its piston guide 20*a* radially outward. This can prevent particles from falling along the piston 20 into the interior of the fastener-setting tool 100. The piston sealing ring 45 may be designed as a metal ring for example and slides under elastic initial tension on the piston 20. The piston brake 27 is retained in a bracket 62, which also comprises the piston guide 20*a* formed as a drilled hole.

Figure 8:
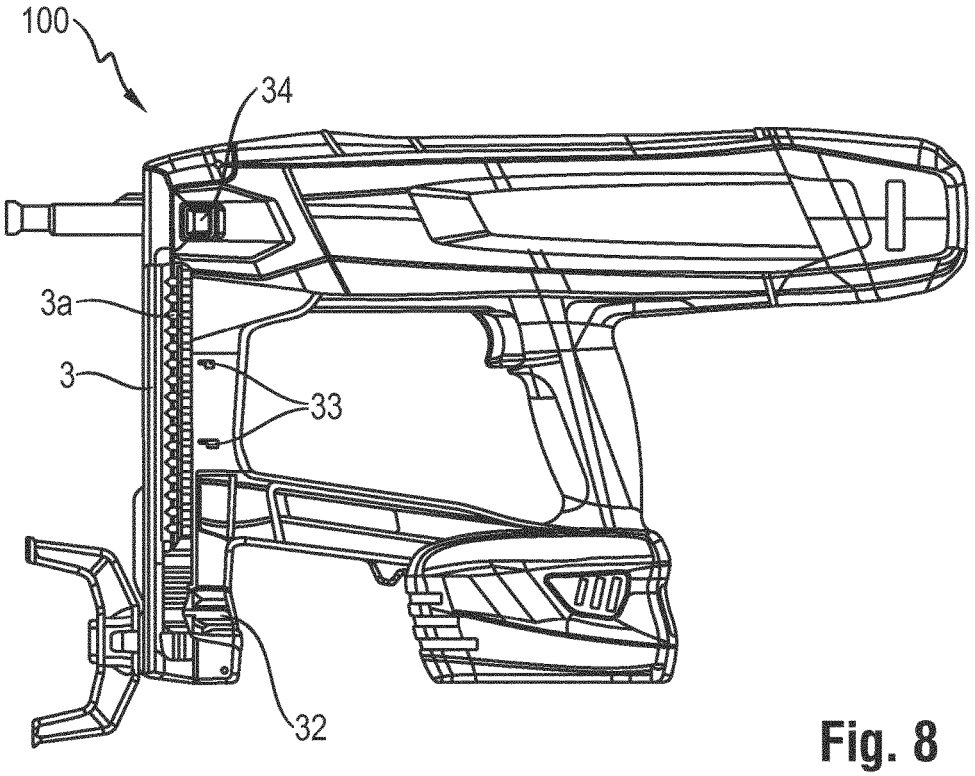
FIG. 8 shows a side view of a driving device.

FIG. 8 shows the second housing part 72 of the fastener-setting tool 100. In particular, the magazine 3 with the nails 3*a* is visible. The nails are transported by a spring-loaded magazine slide 32. The position of the magazine slide 33 is marked directly on the housing shell as a fill level indicator. If the number of nails falls below a minimum, pressing the fastener-setting tool 100 into place is prevented. This is accomplished by a nail detection mechanism, which detects the spring force 32 of the magazine slide onto a nail 3*a* that may be ready for setting. In a preferred embodiment, a slot in which the magazine slide runs is at least partially closed off by an elastic cover not shown here. This can reduce entry of dirt into the tool.

The fastener-setting tool 100 offers the possibility of setting fasteners that do not fit the magazine due to their dimensions as individual elements. For this purpose, the individual setting button 34 can be pressed when the magazine 3 is empty. This allows pressing the fastener-setting tool 100 into contact when the magazine 3 is empty. When the individual setting button is pressed, a single element can be loaded from the front into the fastener guide 2. Because the individual setting button 34 is kept pressed by the magazine slide 32 in its most forward position, it is possible to prevent individual setting when the magazine is loaded, i.e. when the magazine slide 32 is in its rear position.

Figure 9:
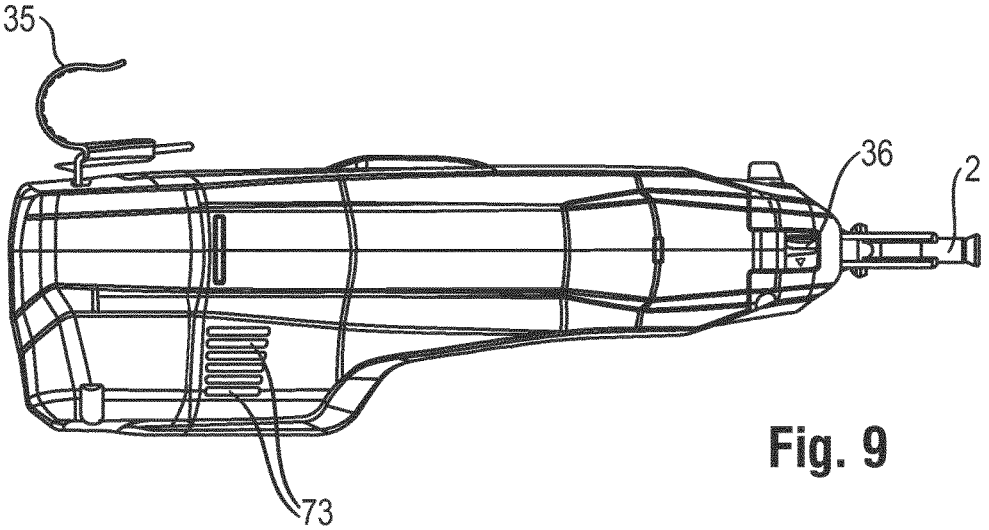
FIG. 9 shows a plan view of a driving device.

FIG. 9 shows the fastener-setting tool 100 in a plan view. The fastener-setting tool 100 has a fastener-ejection slide 36. By pressing on the fastener-ejection slide 36, a user can detach the fastener guide 2 from the fastener-setting tool 100. This is particularly advantageous if elements jam in the fastener guide 2. The latter can then be removed and cleaned. A scaffold hook 35 is pushed onto the fastener-setting tool 100. Ventilation slots 73 for the motor 11 are also shown.

Figure 10:
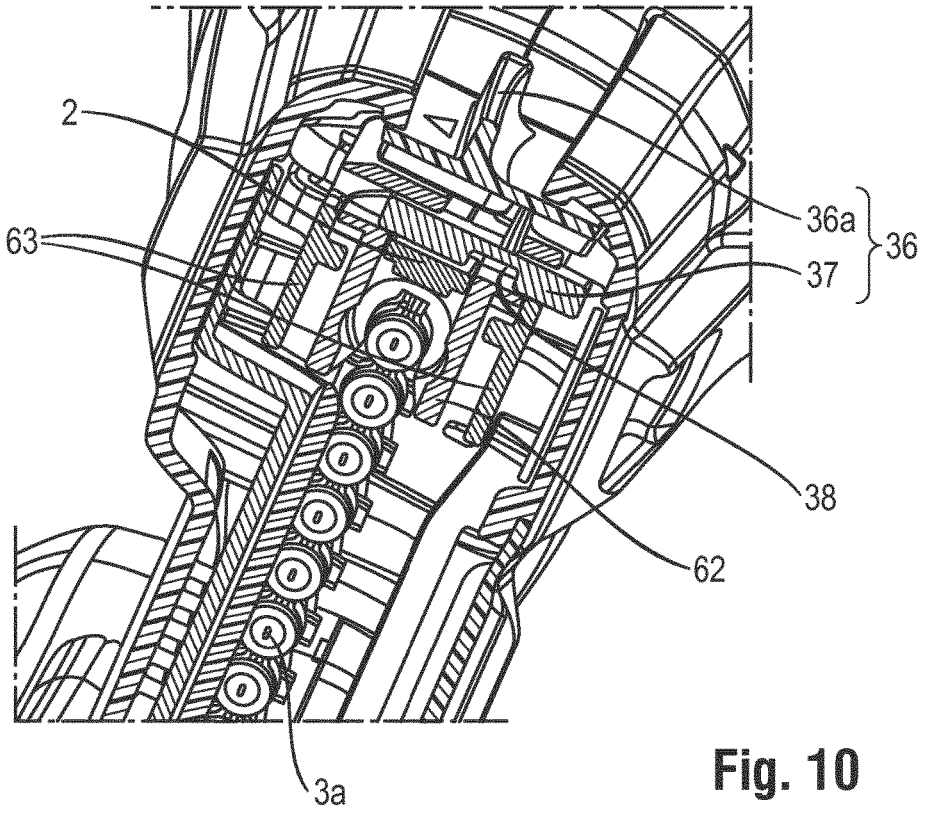
FIG. 10 shows a partial view of a driving device.

As shown in FIG. 10, the fastener-ejection slide 36 is designed in two parts. The actuating element 36*a* is mounted in the housing and drives an internally positioned latch 37, which has a cutout 38. If the actuating element 36*a* is pressed, the latch 37 moves into a position that allows the fastener guide 2 to be removed to the front (toward the viewer in FIG. 10). This happens because a cam, not shown, on the fastener guide 2 can slide forward through the cutout 38 in the latch 37. If the actuating element 36*a* is not pressed, the latch 37 blocks the cam of the fastener guide 2. A spring is used to reset the latch 37 and the actuating element 36*a*.

The bracket 62 for the piston brake 27 is used as a guide for the fastener guide 2 and the piston 20. The bracket 62 also guides the nail-detection slide, not shown here, and the fastener-ejection slide 36. These individual parts are resiliently mounted. In order to handle this assembly easily during installation, the bracket is 62 surrounded laterally by a two-part clamp 63 that secures the mounted individual parts.

Figure 11:
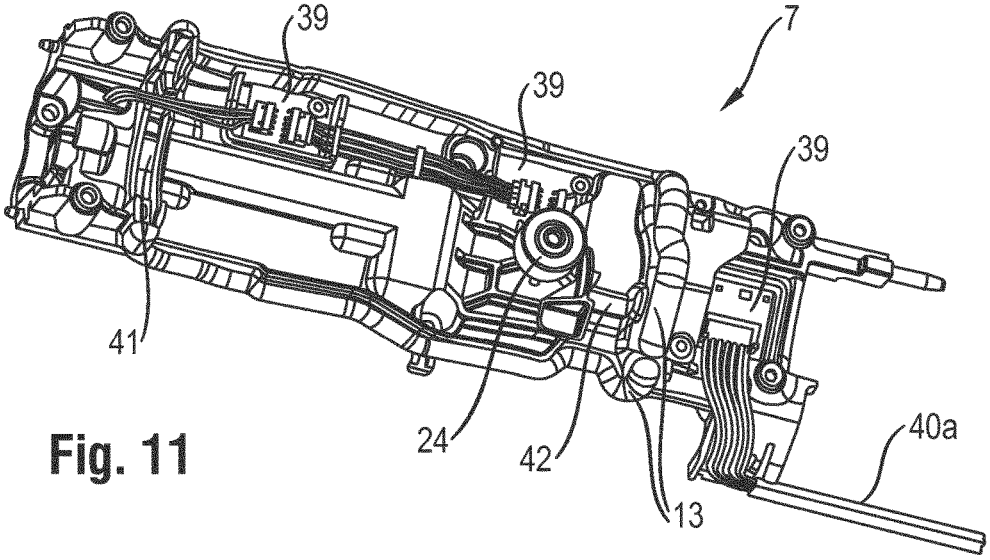
FIG. 11 shows an intermediate element.

FIG. 11 shows the intermediate plate 7. The intermediate plate 7 is used as a support for a number of sensor circuit boards 39. The sensor circuit boards 39 carry sensors that generate signals according to the position of other tool components. The control electronics 12 unit controls the fastener-setting tool 100 by means of these signals. For example, the position of a part carrying a permanent magnet may be monitored by means of a Hall sensor. Some sensor circuit boards 39 are connected to one another, by means of plug connections, for example, as shown in FIG. 11, or by fixedly soldered cables. The sensor circuit boards 39 are plugged, snapped or bolted into the intermediate plate 7. A cable 40*a* connects the sensors to the tool electronics. The damped stop 24 for the motor 11 is likewise mounted on the intermediate plate 7. In addition, the intermediate plate 7 comprises the sealing element 13, a slot-like receptacle 41 for the motor damper 23, and an abutment 42 for relieving the tension on the electrical lines 75 for the motor 11.

Figure 12:
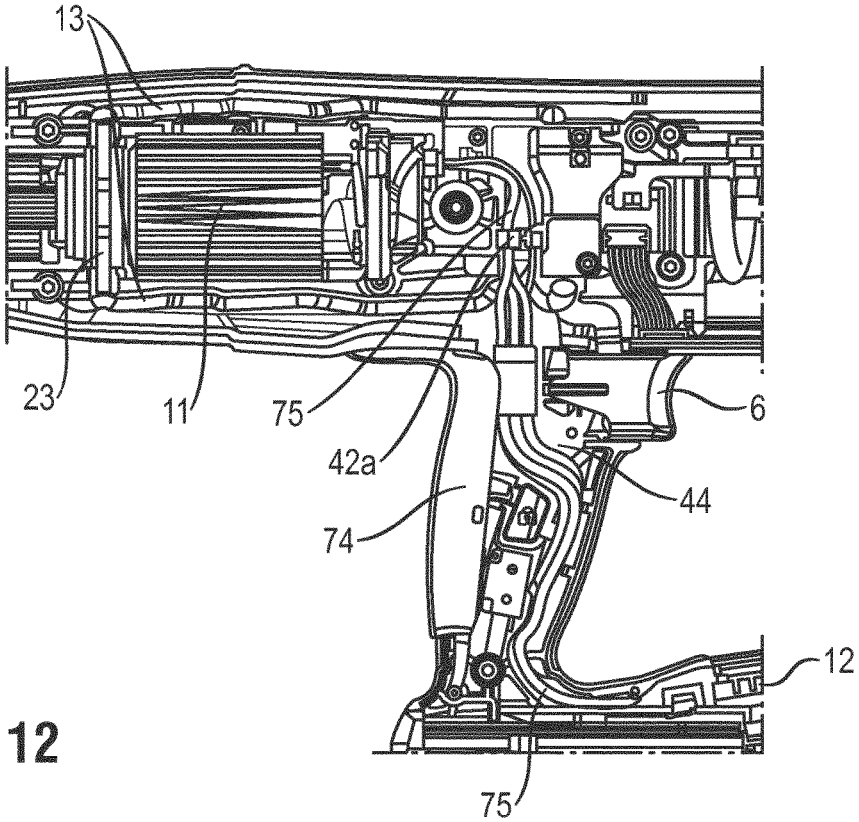
FIG. 12 shows a partial view of a driving device with an opened housing.

The motor damper 23, which is fixedly connected to the motor 11, can be seen in FIG. 12. The motor damper 23, along with the motor 11, is axially and radially fixed in the slot-like receptacle 41 and a matching opposing contour on the housing 1. The electrical lines 75 of the motor 11 are clamped against the abutment 42 by means of a clamping element 42*a*. Molded-on plastic parts, which can be plugged into the abutment 42 in the intermediate plate 7, are located on the electrical lines 75. This realizes a relief of tension for the electrical lines 75. The electrical lines 75 are guided and run through the handle area 74 to the control electronics 12. For this purpose, a cable duct 44, which is also provided for part of the support of the trigger 6 in addition to receiving the cable, is located in the handle. Together with the sealing element 13, the motor damper 23 is used for dust-tight separation of the first partial chamber from the second partial chamber.

Figure 13:
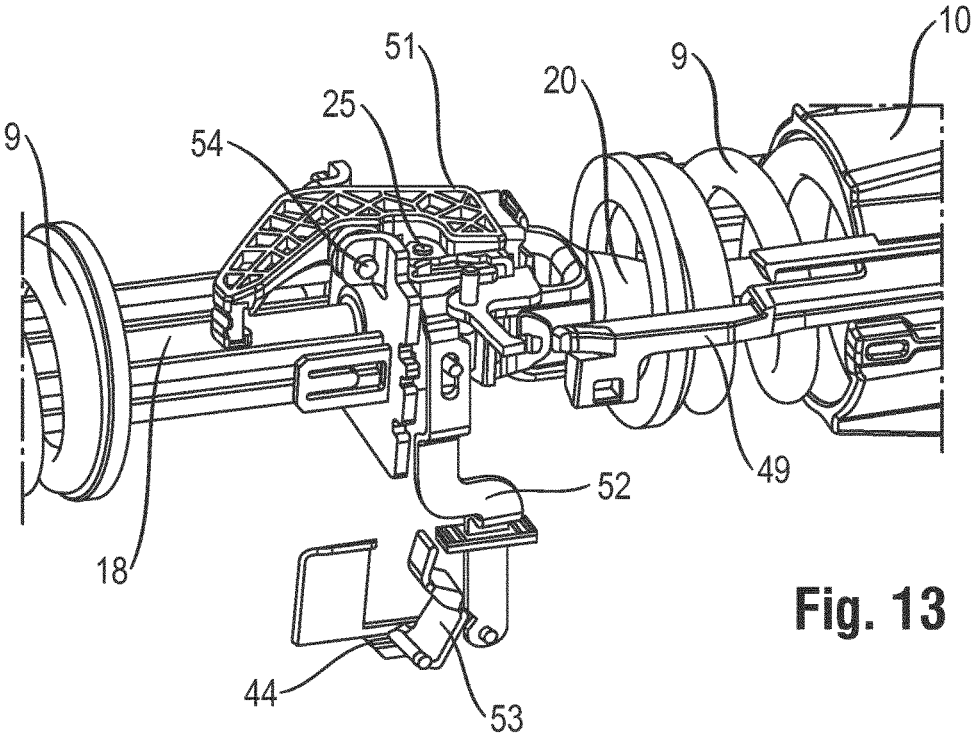
FIG. 13 shows a partial view of an energy transmission device.

FIG. 13 shows the trigger mechanism of the tool in the initial state. The fastener-setting tool 100 comprises a clutch 25, which is able to hold the piston 20 in its initial position against the force transmitted by the tensioning belt, not shown here. The clutch 25 is held closed by a pawl 51. If the helical springs 9 are tensioned and the fastener-setting tool 100 is pressed against the underlying surface, the pawl 51 can be pushed outward by a triggering plate 52. In the process, the pawl 51 turns about an axis of rotation 54 and thus releases the clutch 25. The piston 20 then moves in the direction of the nail 3*a* (to the right in FIG. 13) and drives the nail 3*a* into the underlying surface. The triggering plate 52 is driven via a deflection lever 53 when the user presses the trigger 6. The pawl 51 is advantageously made from a very rigid fiber-reinforced plastic material. Thereby it is light, reacts quickly and is nevertheless stiff enough to be able to handle its function.

Figure 14:
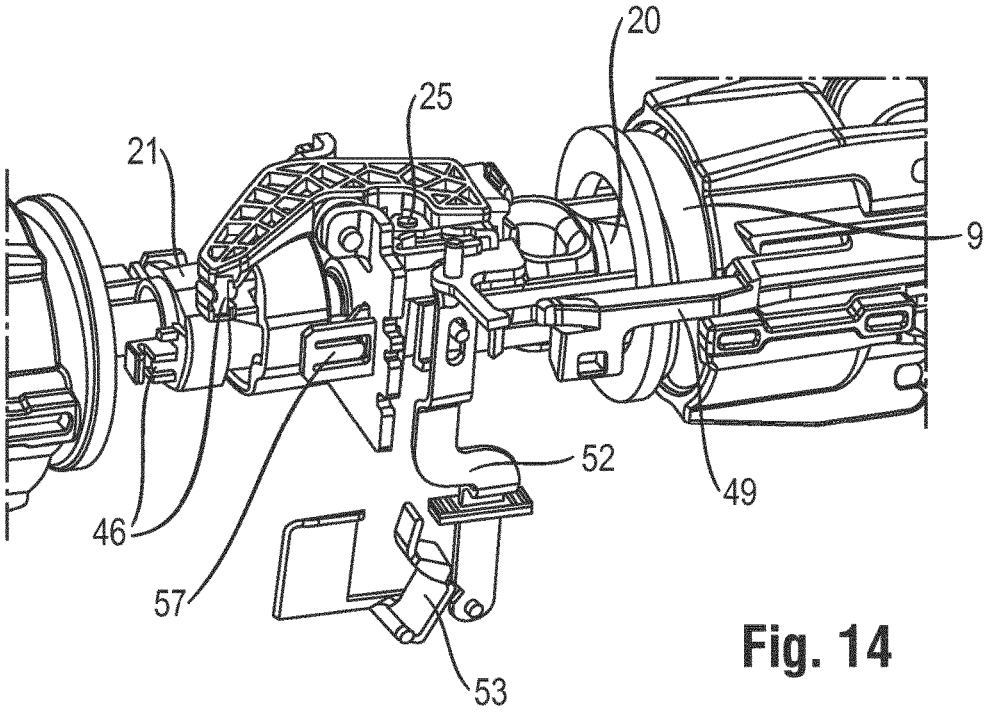
FIG. 14 shows a partial view of an energy transmission device.

FIG. 14 shows the trigger mechanism when the helical springs 9 are tensioned. The helical springs 9 are tensioned by pulling the tensioning belt via the spindle nut 21 in the direction of the clutch 25 while holding the piston 20 in the clutch 25. At the end of this tensioning movement, the triggering plate 52 is pushed by the transmission element 57 into a position that allows it to come into contact with and trigger the pawl 51. The spindle nut 21 has a snapped-in magnet 46, which is used to determine the position of the spindle nut 21.

Figure 15:
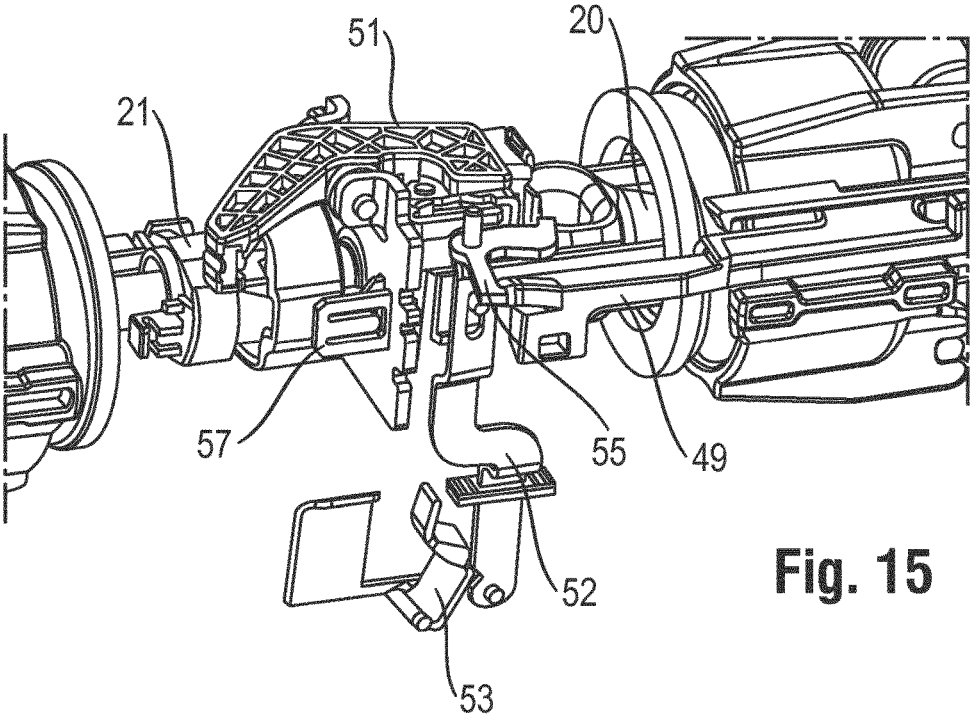
FIG. 15 shows a partial view of an energy transmission device.

FIG. 15 shows the triggering mechanism when the fastener-setting tool 100 is pressed against the underlying surface. Due to this pressing contact, the fastener guide 2 is pushed into the tool. This movement is transmitted by a pressing rod 49 onto a blocking lever 55. This blocking lever is used to block or enable the movement of the pawl 51. The pawl 51 is enabled via the pressing motion but not actuated.

Figure 16:
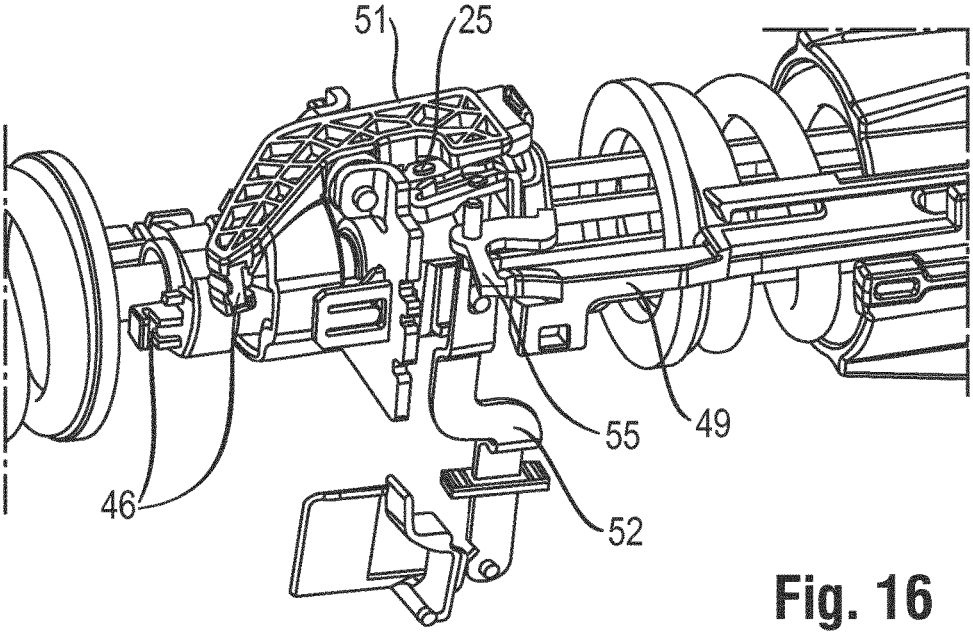
FIG. 16 shows a partial view of an energy transmission device.

FIG. 16 shows the triggering mechanism with setting triggered. The triggering plate 52 has pressed the pawl 51 outward and released the clutch in the process. The piston moves into a front position no longer visible here. The pawl 51 likewise has a snapped in magnet 46, which is used to detect the position of the pawl 51 and thus the shifting position of the clutch 25.

Figure 17:
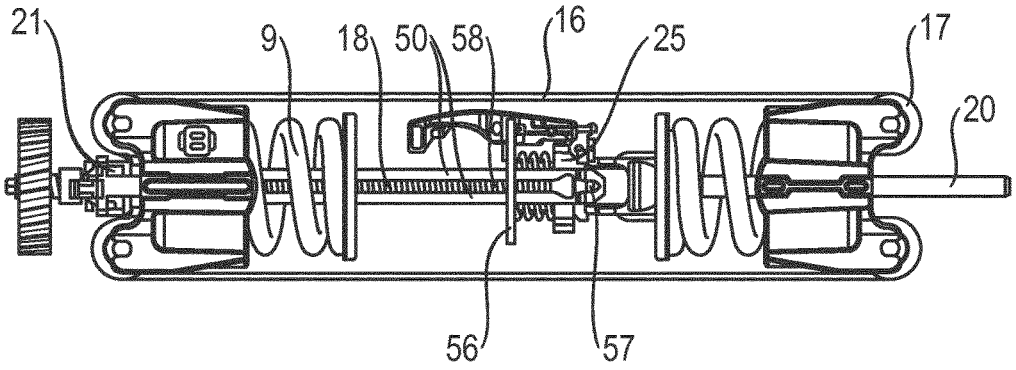
FIG. 17 shows a side view of an energy transmission device.

FIG. 17 shows the helical springs 9 and the energy transmission device comprising the tensioning belt 16, the deflection rollers 17, the ball screw 18, the piston 20 and the clutch 25. The clutch 25 is held by a plate 56, which is seated in the housing. Two hooks 50 are fastened to the spindle nut 21. They move with the spindle nut 21 and are guided in the plate 56. The hooks 50 each have a slot 58 in which a cam 57 fastened to the piston runs. After the setting, the slot 58 and its closed end on the side facing the spindle nut 21 allow the spindle nut 21 to pull the piston 20 into its initial position in the clutch 25. The cams 57 on the piston 20 are each produced as part of the piston. In embodiments not shown, the cams are produced by a different method and then connected to the piston.

Figure 18:
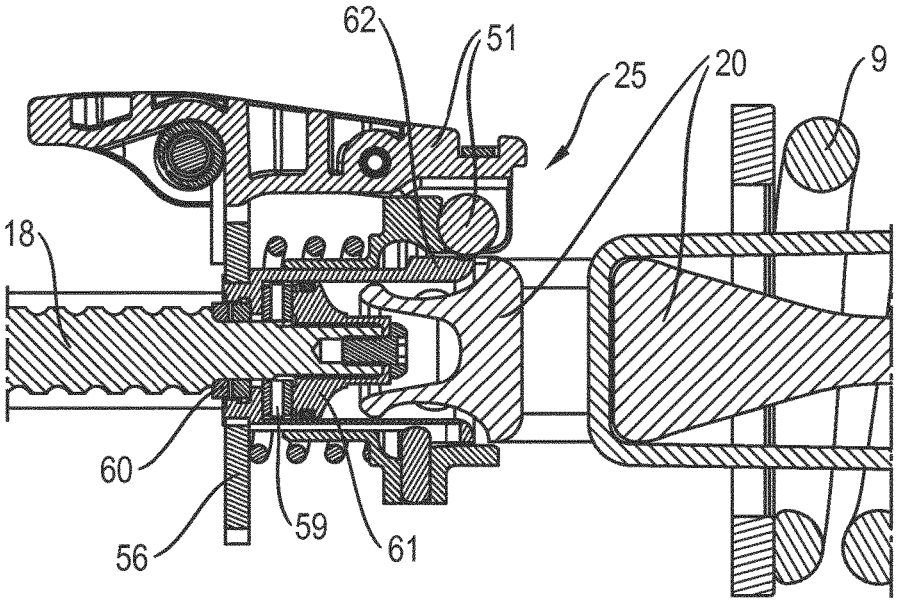
FIG. 18 shows a partial sectional view of an energy transmission device.

FIG. 18 shows a section through the clutch 25. The ball screw 18 is seated in the plate 56. Since high axial forces act upon the ball screw 18 during tensioning of the helical springs 9, the ball screw 18 is supported against the plate via a screwed-on nut 61 on a rolling bearing 59. On the other hand, there are axial forces in the opposite direction during the return of the piston 20 into the clutch 25. These axial forces are absorbed by a sliding bearing ring 60. A clutch hub 62 is form-fittingly connected to the plate 56, for example by orbital riveting. In embodiments not shown, the clutch hub is materially bonded to the plate, e.g. soldered or welded.

Figure 19:
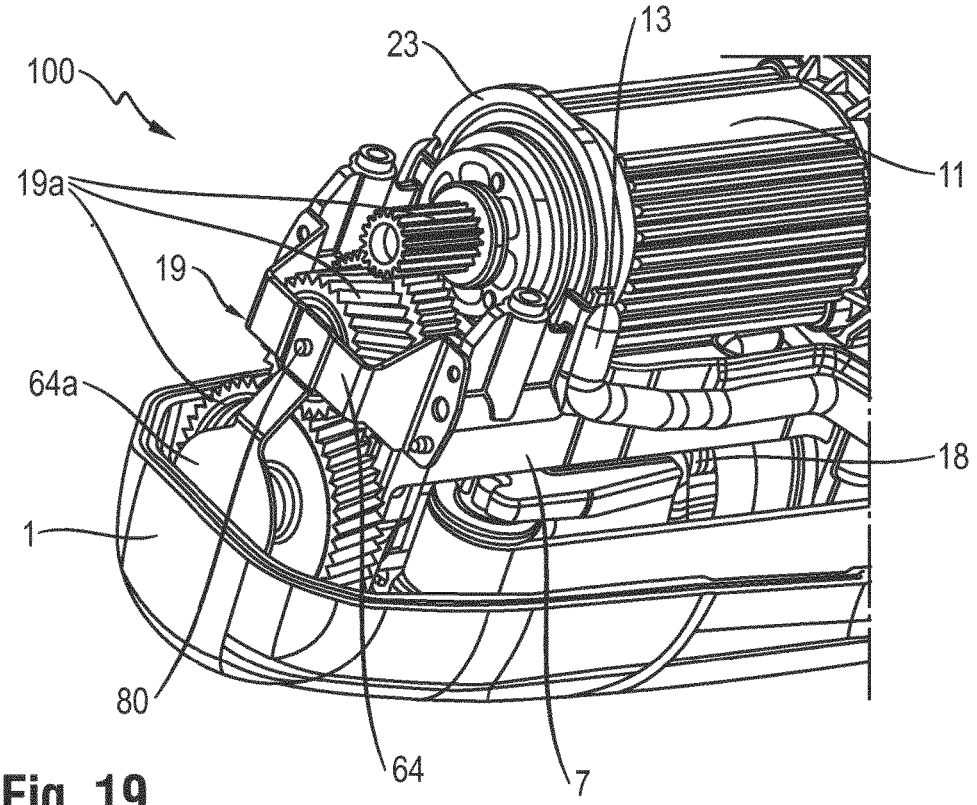
FIG. 19 shows a partial view of a driving device with an opened housing.

FIG. 19 shows the rear part of the fastener driving device 100 with an opened housing 1. The transmission 19 conducts the rotational movement of the motor 11 stepped-down to the ball screw 18. The transmission 19 consists of two stages. The gear wheels 19*a* are produced from plastic materials, for example. The axle 80 of the central gear stage is mounted in the intermediate plate 7 and in a transmission plate 64. The transmission plate 64 itself is bolted onto the intermediate plate 7. This leads to a compact construction. The transmission plate 64 additionally has a protruding tab 64*a*, which extends behind the rotational axis of the ball screw 18. The tab 64*a* protects the ball screw 18 and the gear wheel 19*a* of the third transmission stage in case of an impact on the rear end of the tool (from the left in FIG. 19), for example in case the fastener-setting device 100 is dropped from a great height.

When the housing 1 is closed, the sealing element 13 and the motor damper 23 seal off the first partial chamber, with the transmission 19 therein, from the second partial chamber with the motor 11 therein. The sealing element 13 is designed as an open ring, closed off by the motor damper 23. The sealing element 13 preferably consists of an elastic material, particularly preferably an elastomer, which is sprayed onto or molded onto the intermediate plate 7.

Figure 20:
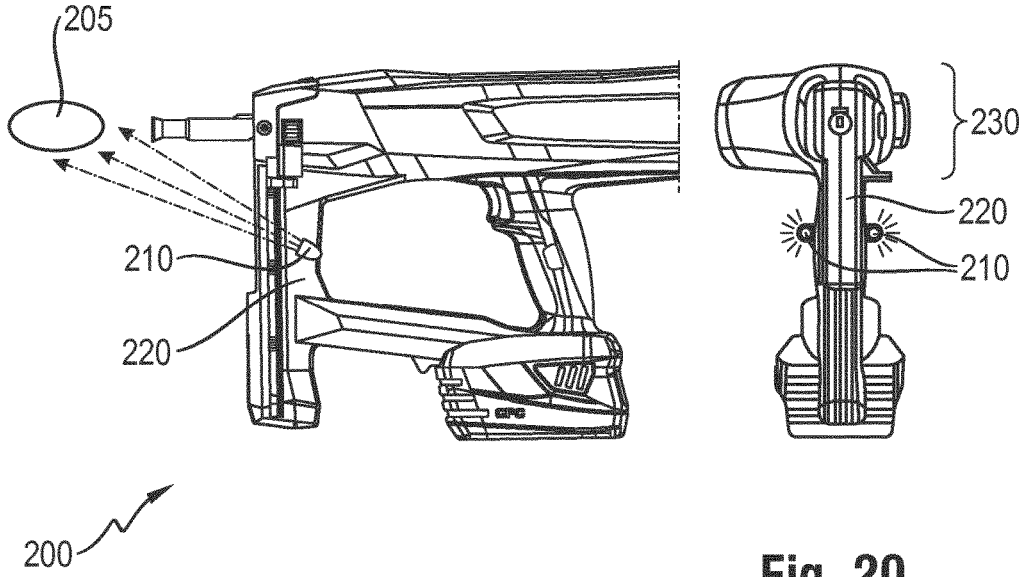
FIG. 20 shows a side and a frontal view of a driving device.

FIG. 20 shows a fastener-setting tool 200 that has two lamps 210 for lighting up the driving region 205 for the fastening element to be set.

The lamps 210 are mounted laterally on the magazine 220, where the accelerations during a setting process are lower than on a main body 230 of the fastener-setting tool 200.

Figure 21:
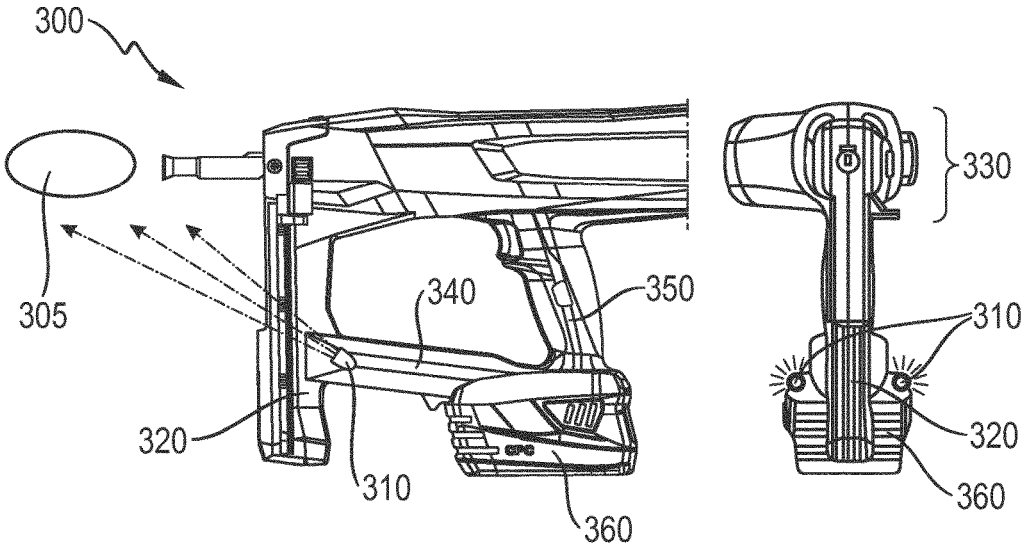
FIG. 21 shows a side and a frontal view of a driving device.

FIG. 21 shows a fastener-setting tool 300 that has two lamps 310 for lighting up the driving region 305 for the fastening element to be set. The lamps 310 are mounted laterally on a connecting bridge 340 between the magazine 320 and a handle 350 as well as a battery 360, the accelerations during a setting process likewise being lower on the connecting bridge than on a main body 330 of the fastener-setting tool 300.

Figure 22:
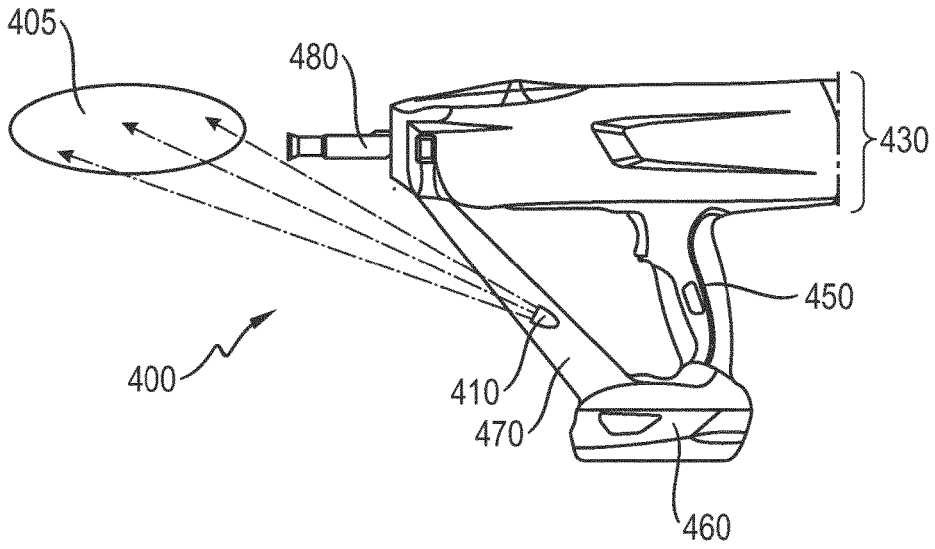
FIG. 22 shows a side view of a driving device.

FIG. 22 shows a fastener-setting tool 400 that has two lamps 410 for lighting up the driving region 405 for the fastening element to be set. The lamps 410 are mounted laterally on a connecting bar 470 between a tip 480 of the tool and a handle 450 as well as a battery 460, the accelerations during a setting process likewise being lower on the connecting bar than on a main body 430 of the fastener-setting tool 400.

Figure 23:
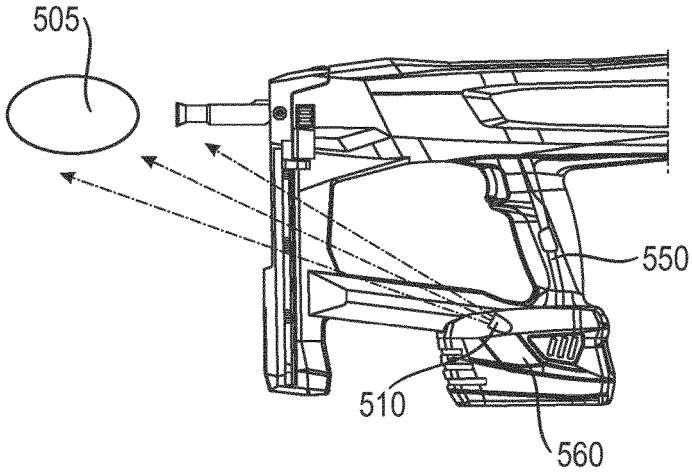
FIG. 23 shows a side and a frontal view of a driving device.
Figure 23:
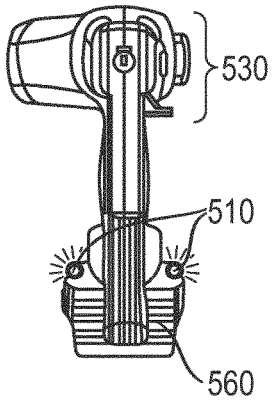

FIG. 23 shows a fastener-setting tool 500 that has two lamps 510 for lighting up the driving region 505 for the fastening element to be set. The lamps 510 are mounted laterally on a handle 550 in the area of a battery 560, where the accelerations during a setting process are likewise being lower than on a main body 530 of the fastener-setting tool 500. In embodiments that are not shown, the fastener-setting tool has only one lamp or more than two lamps. In some embodiments, the lamps are not arranged laterally, but at the front center on the fastener-setting tool, e.g. on the magazine or on the battery. In additional embodiments that are not shown, the fastener-setting tool has a handle switch, which is automatically actuated when the fastener-setting tool is gripped by this handle. Upon actuating the handle switch, the lamp or lamps are switched on, and when the fastener-setting tool is released, the lamps are automatically switched off. In one variant, the fastener-setting tool has an activation switch, upon the actuation of which the lamps and additional tool functions, such as the control electronics in some cases, are switched on. When the activation switch is again actuated, the lamps are again switched off.

Figure 24:
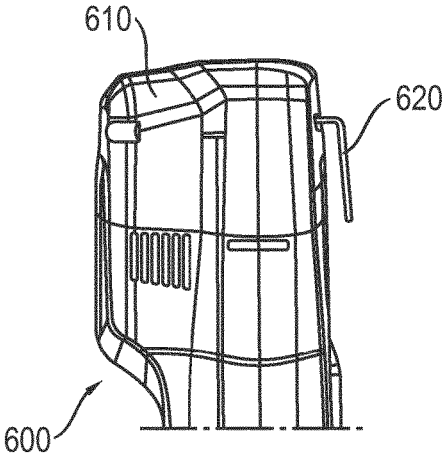
FIG. 24 shows a partial view of a driving device.
Figure 25:
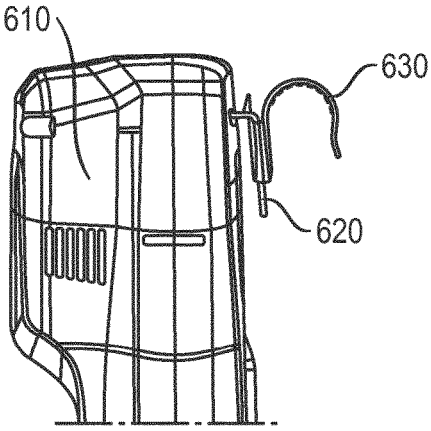
FIG. 25 shows a partial view of a driving device.
Figure 26:
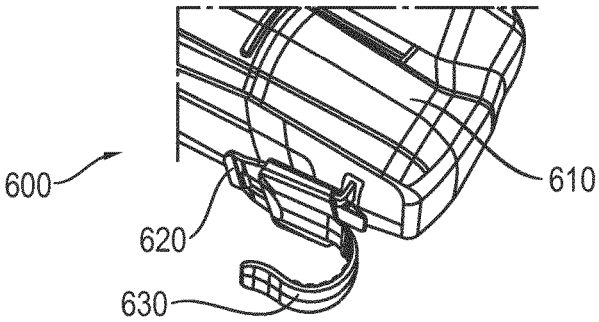
FIG. 26 shows a partial view of a driving device.

FIGS. 24-26 show a fastener-setting tool 600 that has a housing 610. A belt hook 620 is fastened to the housing 610. A scaffold hook 630 can be pushed onto the belt hook 620 if necessary so that the fastener-setting tool can be selectively suspended on a belt or scaffolding. The belt hook 620 is preferably made from metal and the scaffolding hook 630 is made of fiber-reinforced plastic.

Figure 27:
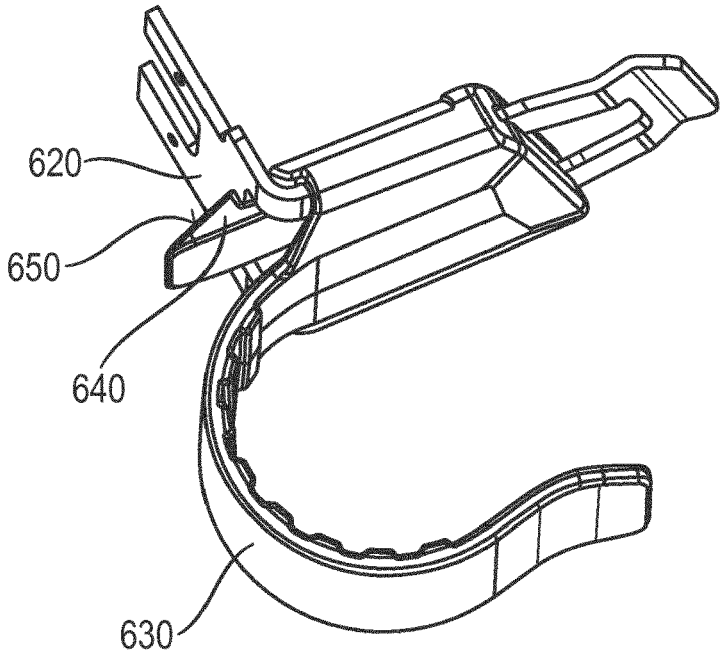
FIG. 27 shows an oblique view of a scaffold hook.
Figure 28:
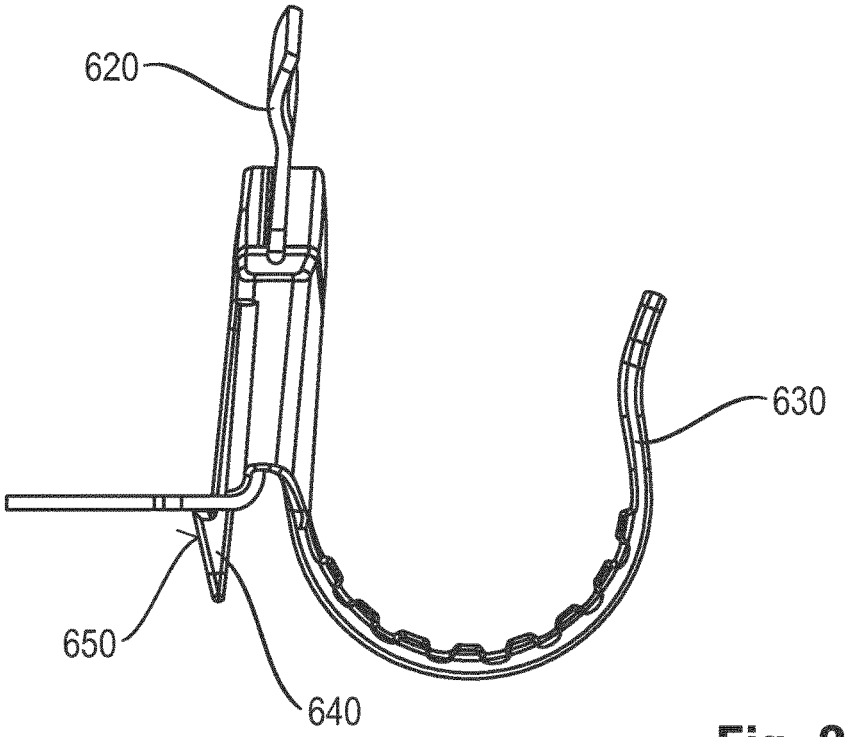
FIG. 28 shows a side view of a scaffold hook.

FIGS. 27 and 28 show the scaffold hook 630 pressed onto the belt hook 620. The scaffold hook 630 has a snap hook

640 for detachably mounting the snap hook 630 on the belt hook 620. The snap hook 640 for its part has an actuating surface 650 for detaching and removing the scaffold hook 630 from the belt hook 620.

The invention claimed is:

1. A device for driving a fastening element into an underlying surface, comprising a mechanical energy accumulator for storing mechanical energy; an energy transmitting element for transmitting energy from the mechanical energy accumulator to the fastening element; an energy transmitting device for transmitting energy from an energy source to the mechanical energy accumulator; a housing with a first housing part and a second housing part, wherein the first housing part is connected to the second housing part to form an interior, and the mechanical energy accumulator is arranged in the interior between the first and second housing part; and an intermediate element, wherein, during assembly of the device, while the mechanical energy accumulator is pretensioned with energy, the intermediate element secures, at least temporarily, the mechanical energy accumulator to the first housing part.

2. The device according to claim 1, wherein the mechanical energy accumulator is supported firstly on the first housing part, and secondly on the intermediate element, against release of the energy stored in the mechanical energy accumulator.

3. The device according to claim 2, wherein the intermediate element divides the interior into a first partial chamber and a second partial chamber.

4. The device according to claim 1, wherein the mechanical energy accumulator is supported only on the first housing part against release of the energy stored in the mechanical energy accumulator.

5. The device according to claim 1, wherein the mechanical energy accumulator is supported only on the intermediate element against release of the energy stored in the mechanical energy accumulator.

6. The device according to claim 1, wherein the intermediate element divides the interior into a first partial chamber and a second partial chamber.

7. The device according to claim 6, wherein the intermediate element separates the first and second partial chambers from one another in a dustproof manner.

8. The device according to claim 7, wherein the intermediate element comprises a sealing element for separation of the first partial chamber from the second partial chamber in an at least partial dustproof manner.

9. The device according to claim 7, wherein the intermediate element separates the first and second partial chambers in an air-tight manner from one another.

10. The device according to claim 7, wherein the first partial chamber is closed off from surroundings of the device in a dustproof manner, and the second partial chamber is ventilated with ambient air.

11. The device according to claim 7, wherein the mechanical energy accumulator is arranged in the first partial chamber.

12. The device according to claim 6, wherein the first partial chamber is closed off from surroundings of the device in a dustproof manner, and the second partial chamber is ventilated with ambient air.

13. The device according to claim 12, wherein the first partial chamber is closed off from the surroundings of the device in an air-tight manner.

14. The device according to claim 6, wherein the mechanical energy accumulator is arranged in the first partial chamber.

15. The device according to claim 6, wherein the energy transmission device comprises a motor that can be mounted on the intermediate element and/or arranged in the second partial chamber.

16. The device according to claim 6, wherein the energy transmission element comprises a transmission that is mounted on the intermediate element and/or arranged in the first partial chamber.

17. The device according to claim 6, wherein the energy transmission device comprises a motion converter having a rotational drive and a linear output, arranged in the first partial chamber, that converts a rotational movement into a linear movement.

18. The device according to claim 17, wherein the motion converter comprises a spindle drive with a spindle and a spindle nut arranged on the spindle.

* * * * *